US008266769B2

(12) United States Patent
Murray et al.

(10) Patent No.: US 8,266,769 B2
(45) Date of Patent: Sep. 18, 2012

(54) CLIP FOR ORNAMENTATION AND METHOD OF USING SAME

(75) Inventors: Terri Annette Murray, Canton, MI (US); Jennifer Wimsatt Mazur, Canton, MI (US)

(73) Assignee: Maisy and Mary, LLC, Canton, MI (US)

( * ) Notice: Subject to any disclaimer, the term of this patent is extended or adjusted under 35 U.S.C. 154(b) by 1167 days.

(21) Appl. No.: 12/117,952

(22) Filed: May 9, 2008

(65) Prior Publication Data

US 2009/0094794 A1 Apr. 16, 2009

Related U.S. Application Data

(60) Provisional application No. 60/998,585, filed on Oct. 12, 2007.

(51) Int. Cl.
*A43B 23/24* (2006.01)

(52) U.S. Cl. ..... 24/3.12; 36/136

(58) Field of Classification Search ..... None
See application file for complete search history.

(56) References Cited

U.S. PATENT DOCUMENTS

| | | | | |
|---|---|---|---|---|
| 3,345,707 | A | 10/1967 | Rita | |
| 4,651,446 | A | 3/1987 | Yukawa et al. | |
| 5,649,342 | A | 7/1997 | D'Andrade et al. | |
| 5,979,085 | A | 11/1999 | Ross et al. | |
| D427,510 | S * | 7/2000 | Gary et al. | D8/395 |
| 6,640,467 | B1 | 11/2003 | Krull | |
| 7,152,286 | B2 | 12/2006 | Rooney et al. | |
| 7,152,367 | B2 * | 12/2006 | Mastronardi | 47/47 |
| 8,069,538 | B2 * | 12/2011 | Wilcox | 24/109 |
| 2007/0084019 | A1 * | 4/2007 | Wilcox et al. | 24/3.1 |
| 2007/0089322 | A1 | 4/2007 | Rooney et al. | |
| 2008/0060110 | A1 | 3/2008 | Schmelzer et al. | |

FOREIGN PATENT DOCUMENTS

| | | |
|---|---|---|
| JP | 07033936 | 6/1995 |
| JP | 9215508 | 8/1997 |
| KR | 20-1988-0011379 | 8/1988 |
| KR | 20-1999-0033796 | 8/1999 |
| KR | 20-0428163 | 1/2006 |

OTHER PUBLICATIONS

International Search Report for Application No. PCT/US2008/079712 dated Apr. 6, 2009.
Written Opinion of the International Searching Authority for Application No: PCT/US2008/079712 dated Apr. 6, 2009.

* cited by examiner

*Primary Examiner* — Jack W. Lavinder
(74) *Attorney, Agent, or Firm* — Reising Ehington P.C.

(57) ABSTRACT

A clip is adapted to be secured to an item fitted using a closure device. The item is typically a shoe that is laced wherein the closure device is a shoelace. The clip includes a base extending between a back end and a forward end. The base defines a bottom surface. A loop extends over the base to receive a portion of the shoelace therethrough. The clip also includes a fastener fixedly secured to the forward end for selectively securing an ornament thereto to display the ornament on top of the shoe over the tongue thereof.

3 Claims, 5 Drawing Sheets

CLIP FOR ORNAMENTATION AND METHOD OF USING SAME

This patent application claims priority from U.S. provisional patent application having application No. 60/998,585, filed Oct. 12, 2007.

BACKGROUND ART

1. Field of the Invention

The invention generally relates to ornaments used to decorate items. More particularly, the invention relates to clips that secure ornaments to items.

2. Description of the Related Art

Decorating items, wearable or otherwise, with ornaments is desirable because it allows the person using the item to personalize the item by changing the way the item looks for as long as the ornament is secured to the item. Increasingly popular are ornaments that are securable to elastic items such as clogs, cell phone cases, bracelets, headbands and the like, all of which are made from a synthetic material that is elastic and having the characteristics of rubber. These ornaments typically have a decorative top, a neck extending down from the top and a lower supportive surface. One such ornament is sold under the trademark Jibbitz®. The problem with such ornaments is that they are limited to use with elastic items that have holes in them.

U.S. Pat. No. 6,640,467, issued to Krull on Nov. 4, 2003 discloses an accessory apparatus for securing a figurine to a shoe. This device has a strip extending between two ends wherein one end is releasably connected to an item and the other end has a cylinder for receiving and securing a figurine thereto. While this item shows the ability to secure an ornament to a non-rubber item, it is not adaptable to be used with ornaments having a decorative top, a neck and a lower support surface. Nor is it capable of having more than one figurine attached to the shoe at a time.

SUMMARY OF THE INVENTION

A clip is adapted to be secured to an item having a closure device. The clip includes a base extending between a back end and a forward end. The base defines a bottom surface. A loop extends over the base to receive a portion of the closure device for the item therethrough. The clip also includes a fastener fixedly secured to the forward end for selectively securing an ornament thereto to display the ornament on top of the item.

BRIEF DESCRIPTION OF THE DRAWINGS

Advantages of the invention will be readily appreciated as the same becomes better understood by reference to the following detailed description when considered in connection with the accompanying drawings, wherein.

DETAILED DESCRIPTION OF THE PREFERRED EMBODIMENT

Figure 1:
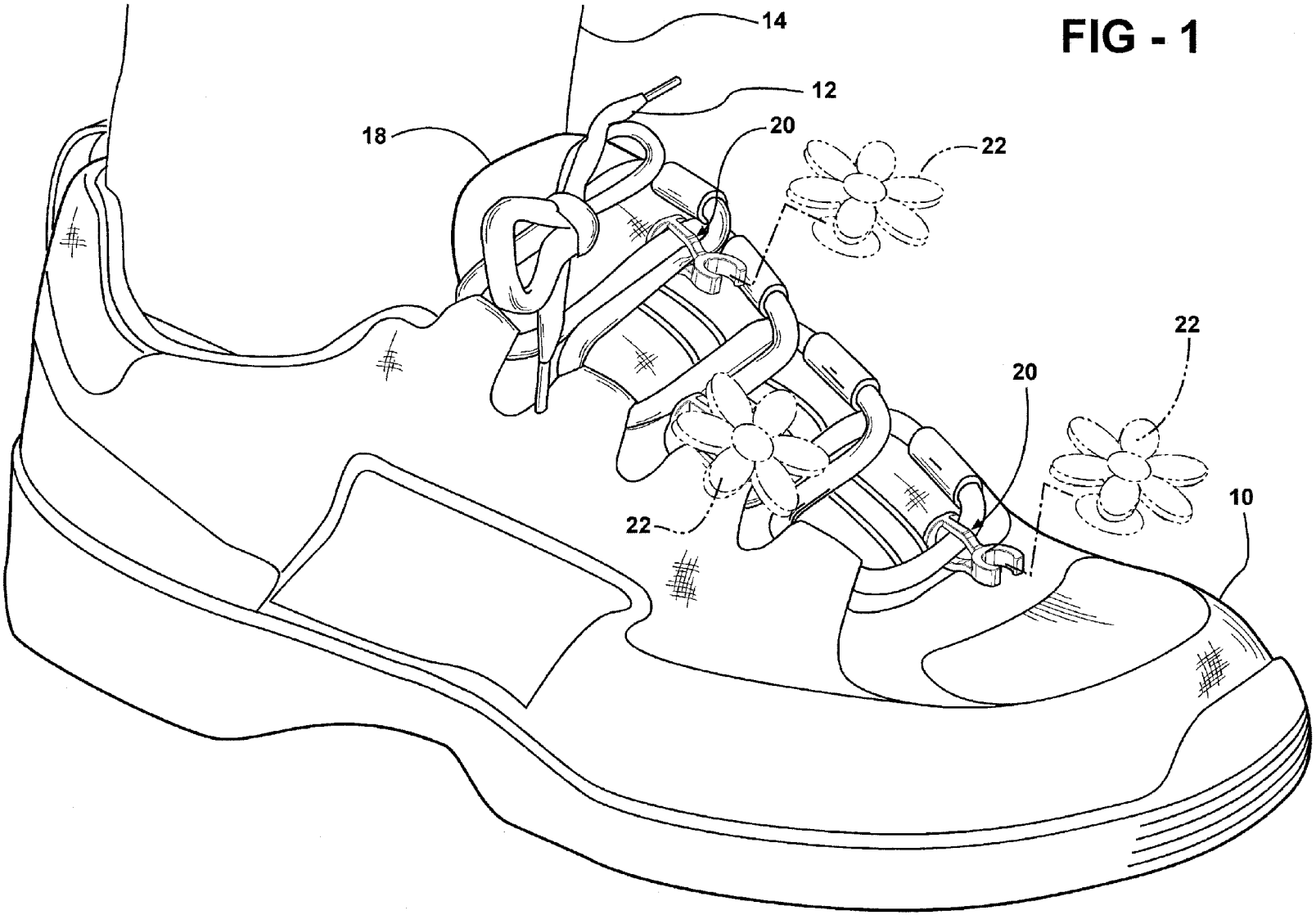
FIG. 1 is a perspective view of an item incorporating one embodiment of the invention to secure ornaments thereto.

Referring to FIG. 1, an item 10 is shown. The item 10 is an item that is fitted using a closure device 12, which in this embodiment is a shoelace. The shoelace 12 has a serpentine configuration and is tied at the top of the item 10 adjacent an opening for a foot, graphically represented by a leg 14 to be inserted. While the item 10 is shown to be a shoe and the closure device 12 is shown to be a shoelace, it should be appreciated by those skilled in the art that the item 10 and closure device 12 may be something other than a shoe. By way of example, and in no way limiting, the item 10 may be a clothing item, or any article that incorporates a closure device 12 either functionally or aesthetically.

Figure 2:
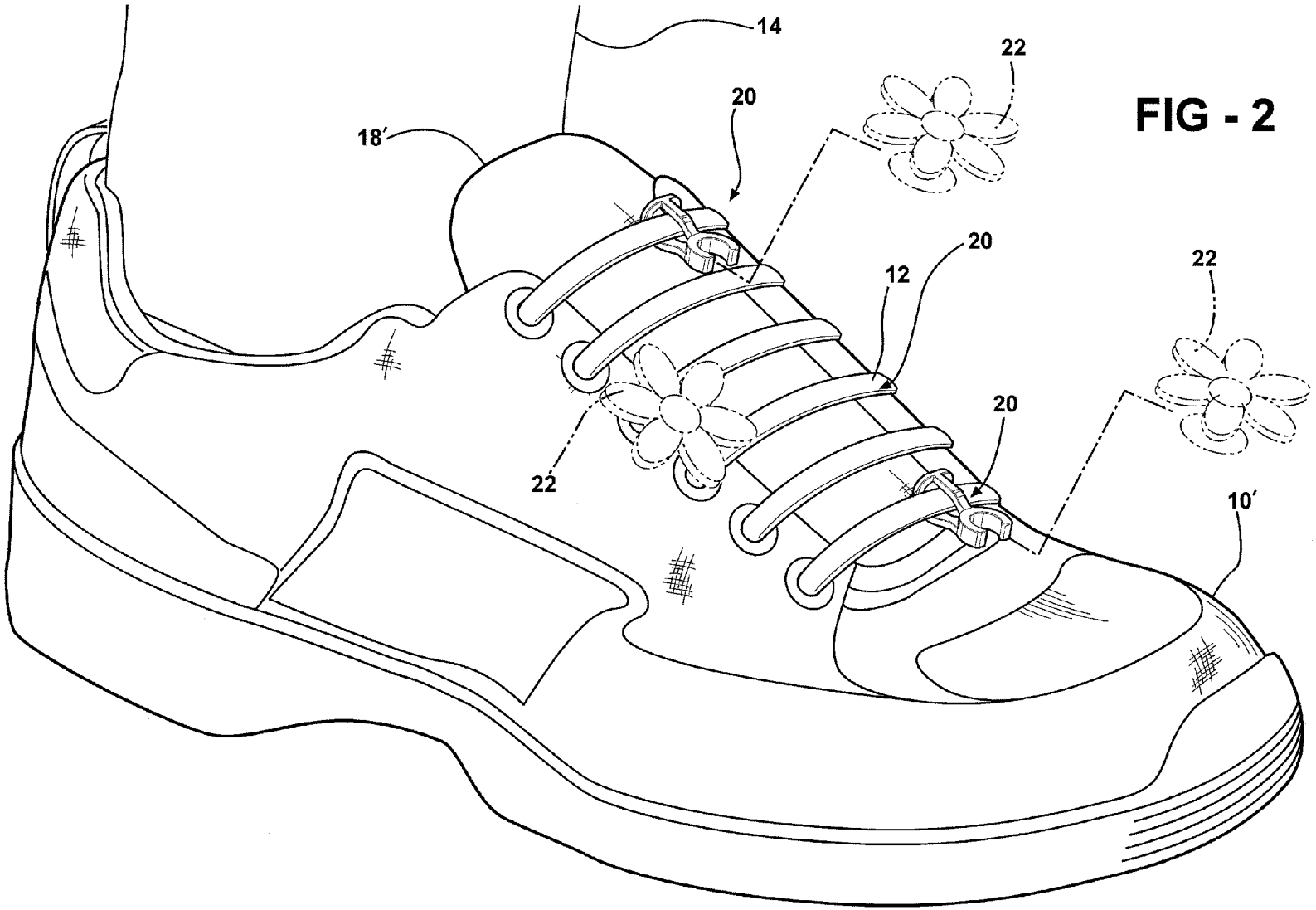
FIG. 2 is a perspective view of a second item with the invention secured thereto.
Figure 3:
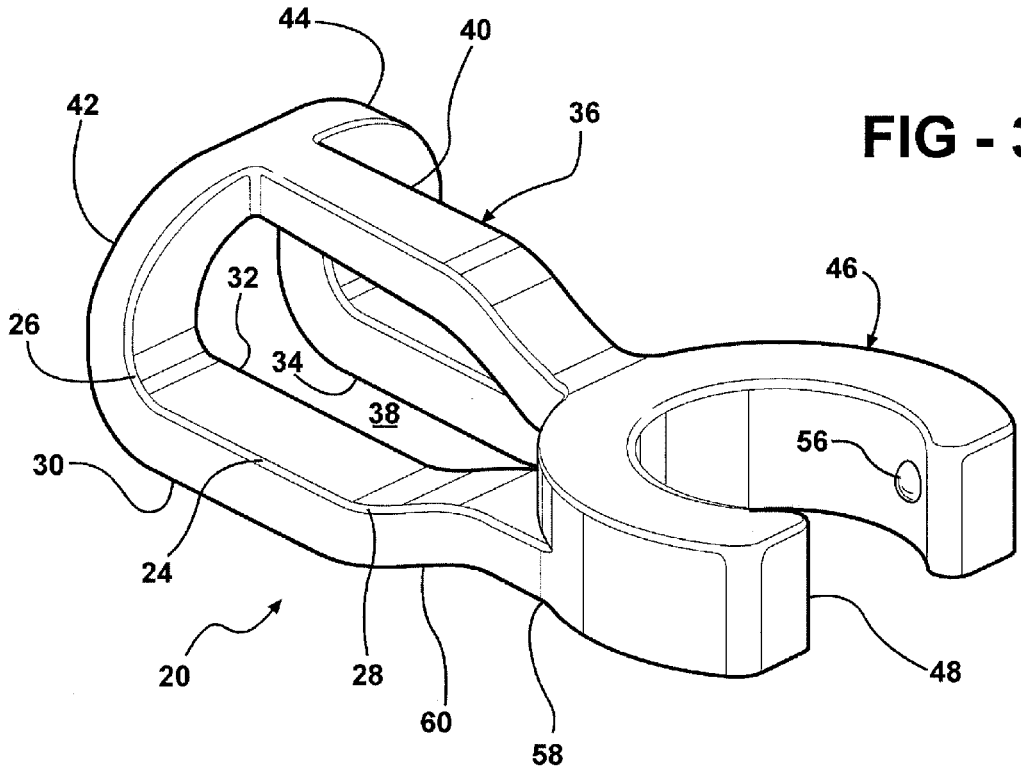
FIG. 3 is a perspective view of the invention.
Figure 4:
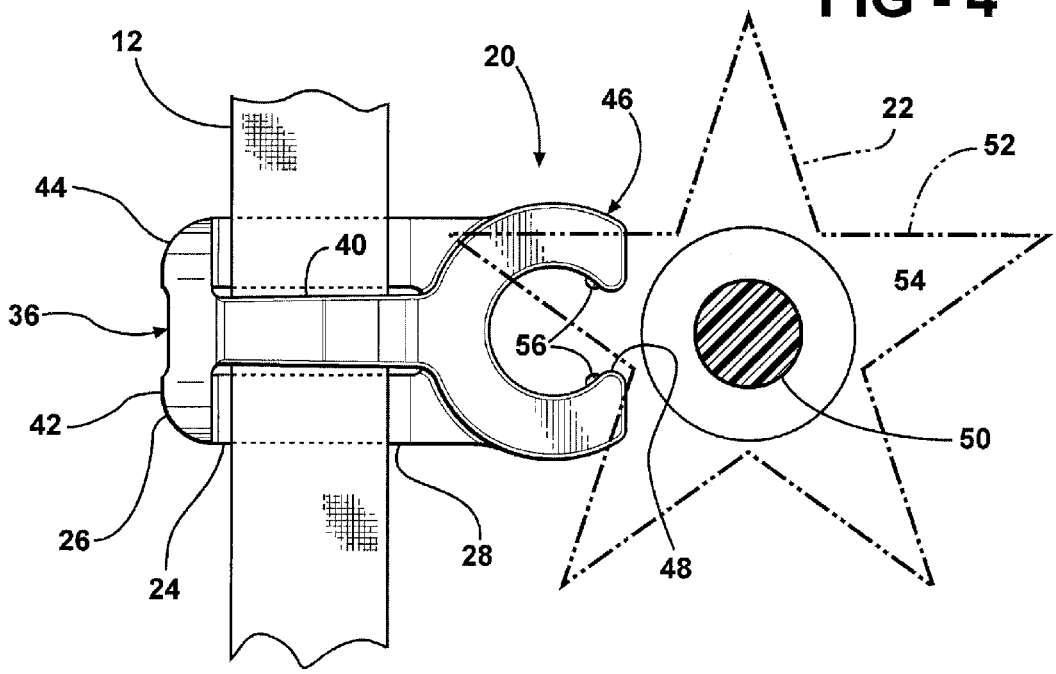
FIG. 4 is a top view of the invention secured to a closure device with an ornament in close proximity thereto.

Referring to FIG. 2, wherein like prime numerals represent similar elements, the item 10' is a shoe that is fitted over a foot 14 using a closure device 12' that is different than the closure device 12 of FIG. 1. In particular, this closure device 12' is an elastic member that extends from parallel eyelets 16 across a tongue 18'. Each of the closure devices 12' extends from one eyelet 16 on one side of the tongue 18' to another eyelet (not shown). These closure devices 12' are similar to those sold under the trade name "Golaces" as marketed by Jibbitz, LLC. The closure devices 12' are fabricated from material of varying colors.

Referring to FIGS. 1 and 2, the invention, a clip, is generally indicated at 20. The clip 20 is designed to be secured to the item 10, 10' (hereinafter the shoe 10) so that it can secure an ornament 22 (shown in phantom in FIGS. 1 and 2) to the shoe 10. There may be any number of ornaments 22 secured to the item 10 using the clips 20. These clips 20 may be positioned in the middle of the shoe 10 or at an edge thereof. One or two portions of the shoelace 12 may extend through the clip 20. And it should be appreciated by those skilled in the art that while only two clips 20 are shown in FIG. 1 and three clips 20 are shown in FIG. 2 that each ornament 22 that is secured to the closure devices 12, 12' have a clip 20 that is underneath the ornament 22 and is securing the ornament 22 to the shoe 10. The clip 20 is adapted to be secured to the item 10 fitted to the foot 14 using the closure device 12.

Referring to FIGS. 3 through 6, the clip 20 is generally shown. The clip 20 defines a base 24 extending between a back end 26 and a forward end 28. The base 24 defines a bottom surface 30. The base is comprised of two arms 32, 34 that extend parallel to each other and complement each other.

The clip 20 also includes a loop, generally indicated at 36. The loop 36 extends over the base 24. In the embodiment shown, the loop 36 extends over an opening 38 created by the two parallel arms 32, 34 of the base 24 to create a device receiving opening 39. It should be appreciated by those skilled in the art that if the base 24 were fabricated with a single piece, the loop 36 would extend over the middle of the base 24. The loop 36 includes a principle loop segment 40 and two secondary loop segments 42, 44. The principle loop segment 40 extends over the base 24 and divides into the secondary loop segments 42, 44, which are used to connect the loop 36 to the base 24 at the back end 26 thereof. The loop 36 receives a portion of the closure device 12 therethrough. This can best be seen in FIGS. 4 and 5 where the closure device 12 is shown. In the one embodiment shown in FIGS. 1 through 6, the loop 36 is closed.

Figure 7:
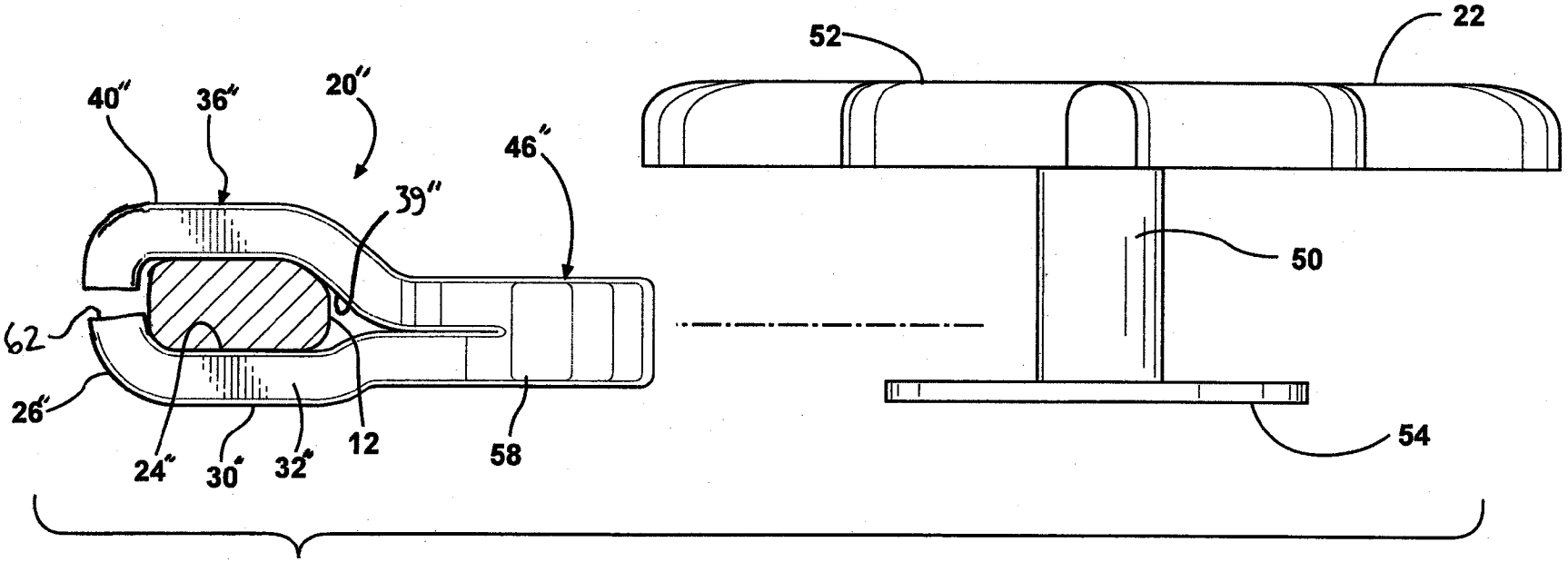
FIG. 7 is a second embodiment of the invention.

Referring to FIG. 7, wherein like double primed numerals represent similar elements as shown and discussed above in FIGS. 1 through 6, the loop 36" is open allowing the closure device 12 to slide into the loop 36" via a gap 62 as opposed to "lacing" the loop 36" through its device receiving opening 39". In this second embodiment, the loop 36" would either squeeze or clamp down on the closure device 12, or it may be pried open temporarily to allow the closure device 12 into the loop 36" whereby removal of the separating force will lessen the gap 62 preventing the closure device 12 from leaving the loop 36". The force applied could either force the gap 62 open longitudinally or laterally. The loop 36" may be narrower or equal in width to the base 24".

Figure 5:
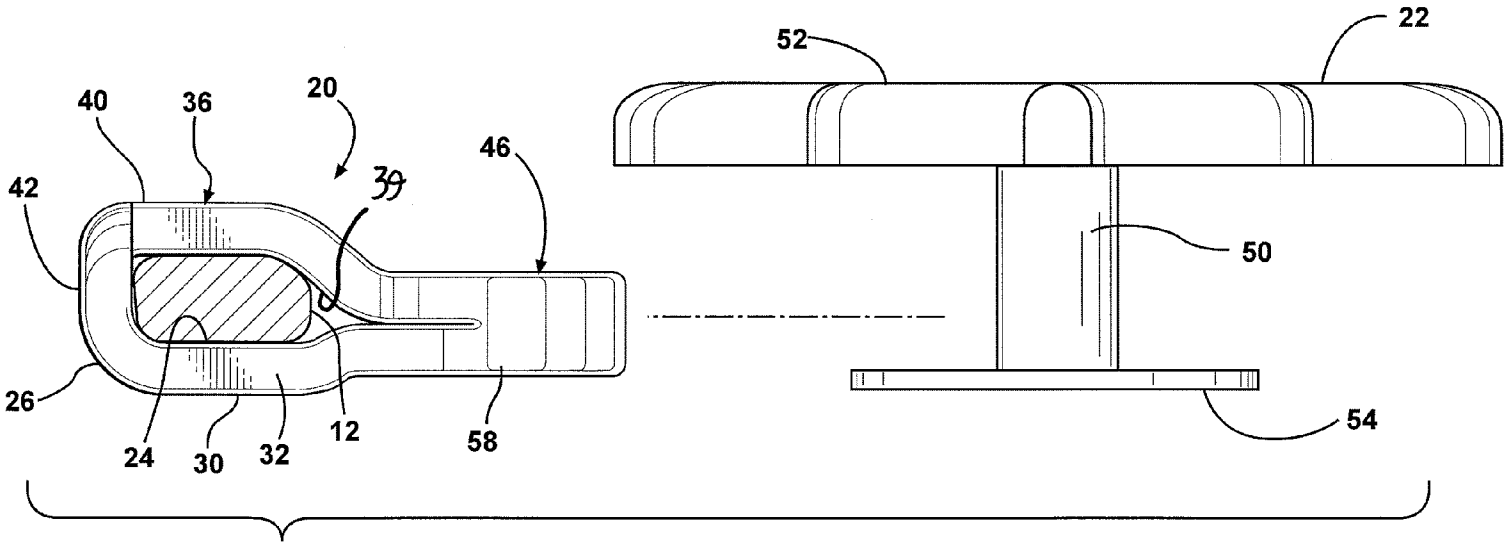
FIG. 5 is an exploded side view of the invention and an ornament being secured thereto with a closure device shown in cross-section.
Figure 6:
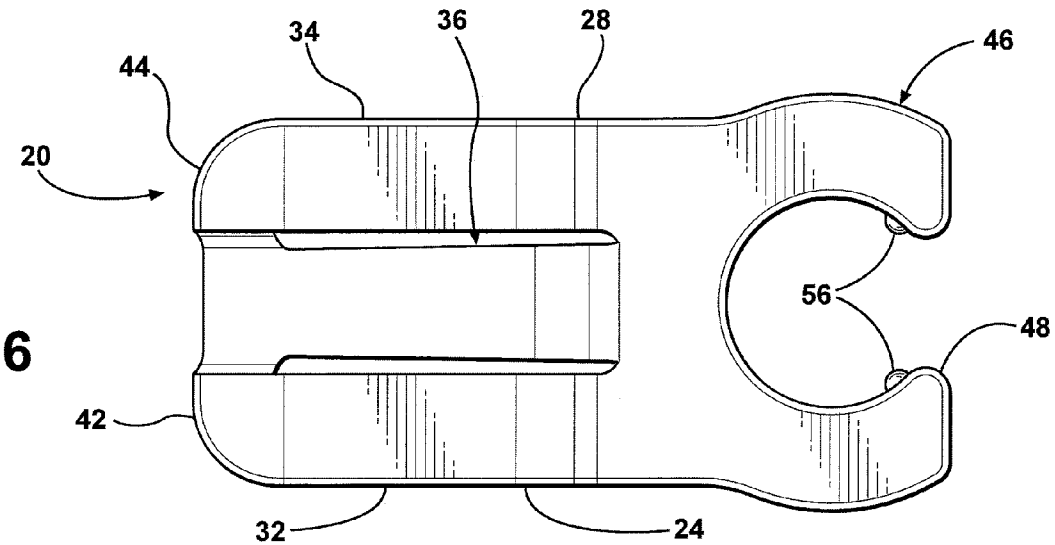
FIG. 6 is a top view of the invention.

The clip 20 also includes a fastener, generally indicated at 46. The fastener 46 is fixedly secured to the forward end 28 of the base 24 and the loop 36. The fastener 46 selectively secures an ornament 22 thereto allowing the display of the ornament 22 on top of the shoe 10. The fastener 46 is C-shaped. The fastener 46 defines an opening 48 designed to receive the ornament 22 therethrough. As is best shown in FIG. 5, the opening 48 receives a neck 50 of the ornament 22.

The ornament 22 includes a decorative top 52, the neck 50 and a lower support surface 54. The fastener 46 is designed to hold the neck 52 with sufficient force that it cannot move beyond the opening 48 preventing the decorative top 52 or the lower support surface 54 from moving axially through the fastener 46. Therefore, once the neck 50 is inserted through the opening 48 and received by the fastener 46, the ornament 22 is secured in place with respect to the clip 20. The fastener 46 includes two protrusions 56 that facilitate the securing of the ornament 22 within the fastener 46. The two protrusions enable a greater force requirement to remove the neck 50 through the opening 48.

Returning attention to the base 24, the base 24 includes a receiving surface 58 designed to receive a portion of the ornament 22 thereunder. More specifically, the receiving surface 58 receives a portion of the lower support surface 54 thereunder. This reduces the profile of the ornament 22 with respect to the item 10. The base 24 includes a relief 60 extending between the bottom surface and the receiving surface 58.

In operation, the clip 20 must be secured to the shoe 10. In order to do this, a portion of the closure device 12 is released. This may require the shoelace 12 to be unlaced or one half of the elastic closure device 12' to be removed from its eyelet 16. The portion of the closure device 12 that is released is passed through the loop 36 of the clip 20. The portion of the closure device 12 is then secured to the shoe 10 in a manner that the base 24 of the clip 20 rests on the shoe 10. The base 24 is wider than the loop 36 and this maintains a proper orientation of the clip 20 and eventually the ornament 22, with respect to the shoe 10. Once the closure device 12 is re-secured, the neck 50 of the ornament is inserted into the fastener 46 through the opening 48. The ornament 22 is positioned such that the lower support surface 54 is disposed between the clip 20 and the shoe 10. The decorative top 52 covers a portion of the loop 36 of the clip 20. In many instances with differing designs of the ornament 22, the decorative top 52 may cover the entire loop 36 and the entire clip 20. If desired, the ornament 22 may be removed from the clip 20 while maintaining the clip 20 secured to the closure device 12 of the item 10.

It is contemplated that the clip 20 is manufactured from a clear polymeric material that is relatively rigid enabling it to properly secure an ornament thereto without breaking the fastener 46. By having the clip 20 clear, the clip 20 is less visible should the user of the shoe 10 remove the ornament 22 from the clip 20. It should be appreciated by those skilled in the art that the clip 20 may be fabricated from another material, e.g., nylon or other such material that may be colored should a decorative clip 20 be used instead of a clear clip 20.

The invention has been described in an illustrative manner. It is to be understood that the terminology, which has been used, is intended to be in the nature of words of description rather than of limitation.

Many modifications and variations of the invention are possible in light of the above teachings. Therefore, within the scope of the appended claims, the invention may be practiced other than as specifically described.

We claim:

1. A method of securing an ornament having a decorative top, a neck and a lower support surface to an item, fitted with a closure device, using a clip having a base, a loop and a fastener, the method comprising: releasing a portion of the closure device; passing the portion of the closure device through the loop of the clip; securing the portion of the closure device for the base of the clip to rest on the item; and inserting the neck of the ornament into the fastener to secure the ornament to the item with the clip such that the lower support surface is disposed between the clip and the item.

2. A method as set forth in claim 1 including the step of positioning the ornament within the fastener such that the decorative top covers a portion of the loop of the clip.

3. A method as set forth in claim 2 including the step of removing the ornament from the clip after it is desired to replace or remove the ornament.

* * * * *